United States Patent [19]

Stephens

[11] Patent Number: 4,964,526

[45] Date of Patent: Oct. 23, 1990

[54] CASE FOR FEMININE HYGIENE PRODUCTS

[76] Inventor: Chandra D. Stephens, P.O. Box 725082, Atlanta, Ga. 30339

[21] Appl. No.: 387,990

[22] Filed: Aug. 1, 1989

[51] Int. Cl.[5] ..... B65D 43/16

[52] U.S. Cl. ..... 220/22; 132/315; 206/823; 220/23; 220/259; 220/337

[58] Field of Search ..... 132/286, 314, 315; 206/69, 438, 440, 581, 823; 220/22, 22.1, 23, 256, 259, 326, 337

[56] References Cited

U.S. PATENT DOCUMENTS

| | | | |
|---|---|---|---|
| 1,999,328 | 4/1935 | Lessard | 132/315 |
| 2,638,625 | 2/1953 | Pike | 132/315 |
| 2,740,550 | 4/1956 | Irelan | 220/326 |
| 3,426,768 | 2/1969 | Vardaros | 132/315 |
| 4,211,337 | 7/1980 | Weavers et al. | 220/337 |
| 4,421,127 | 12/1983 | Geer | 132/315 |
| 4,555,020 | 11/1985 | Campello et al. | 206/581 |
| 4,799,604 | 1/1989 | Okojima et al. | 220/326 |
| 4,821,751 | 4/1989 | Chen | 132/315 |
| 4,826,014 | 5/1989 | Schefer | 206/581 |

FOREIGN PATENT DOCUMENTS

| | | | |
|---|---|---|---|
| 2168326 | 6/1986 | United Kingdom | 206/823 |

*Primary Examiner*—Jimmy G. Foster

*Attorney, Agent, or Firm*—Michael V. Drew

[57] ABSTRACT

A case for feminine hygiene products has a bottom compartment and a top compartment configured to receive a variety of feminine hygiene products. A lower retaining plate fits over the bottom compartment and an upper retaining plate fits over the top compartment to help maintain the position of products placed in the compartments. The case is rigid, streamlined, compact, aesthetically pleasing and protects enclosed products from damage and contamination or sullying.

14 Claims, 7 Drawing Sheets

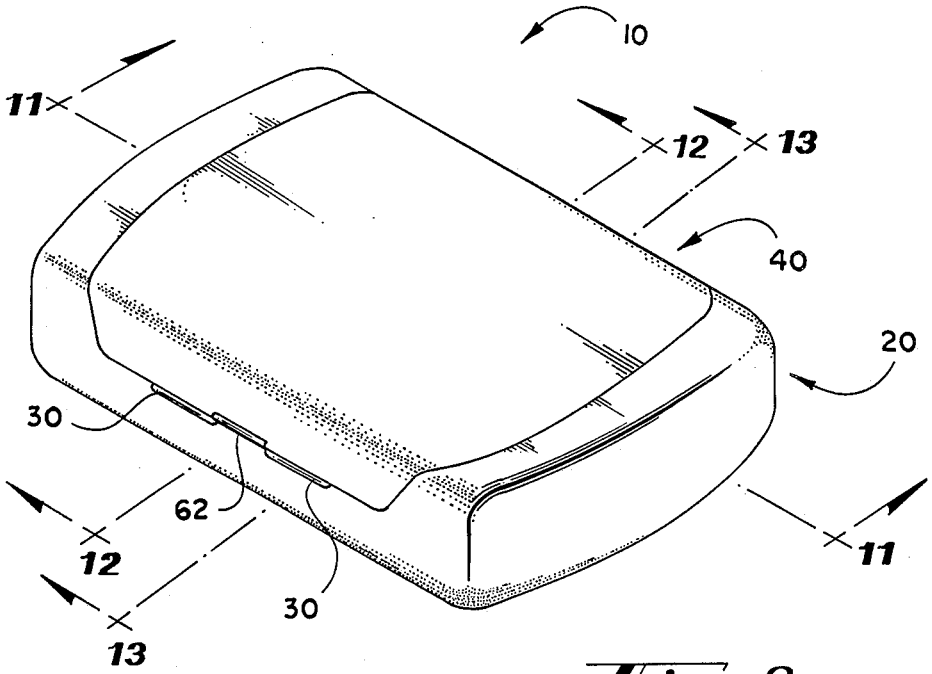
Fig. 8
Fig. 9
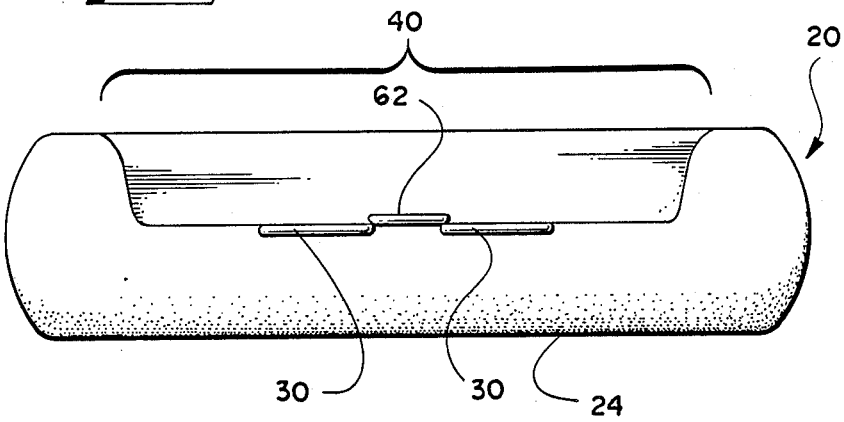

CASE FOR FEMININE HYGIENE PRODUCTS

TECHNICAL FIELD OF THE INVENTION

This invention relates generally to cases for housing feminine hygiene products, and more particularly, to cases of that nature which are aesthetically appealing, can securely hold a variety of feminine hygiene products, and help to prevent damage to and contamination or sullying of the items secured in the case.

BACKGROUND OF THE INVENTION

A variety of hygiene products have been created to meet the specific, particular needs of women. Such products include sanitary napkins, catamenial or other vaginal tampons, panty liners/panty shields and towelettes. These products are sold in a variety of sizes and shapes. Women differ as to their uses of the products. The uses vary from a use of only one product in one size and shape to use of a combination of products in varying sizes and shapes. For example, on a particular day, a woman may desire to use a particular size and shape of tampon and a particular size and shape of panty liners/-panty shields plus towelettes.

Although the uses of products vary, a need common to all women is convenience. Quite simply, women need to have, and want to have, ready access to whichever products they desire to use. Also, when a variety of products will be used, in order to be accessible, all of the products must be in close proximity to one another at the time of desired use.

A woman's need to have selected feminine hygiene products readily accessible becomes even more important, and perhaps critical, when she is away from home. In order to gain quick access to the products, the most convenient place for storage away from the home is within a pocketbook or purse. Other storage possibilities include cosmetic bags, brief cases, desk drawers, glove compartments of motor vehicles, or on the person, possibly in a pocket of an article of clothing which is worn. If a woman is attempting to maintain more than one product item in a pocketbook, purse, bag, brief case, drawer or compartment in a vehicle, the products normally become separated from each other and become intermingled with other sundry items which are kept in the same place. The products are then not as readily accessible as they should be. Accordingly, it will be appreciated that it would be desirable to have a case which is specifically designed for housing a variety of feminine hygiene products of various sizes, shapes, and configurations, which neatly and securely holds those products in place within the case, and which allows quick and easy access to those products.

It is important that feminine hygiene products be protected from contamination or sullying because of the intimate nature of their use. Carrying or storing hygiene products in a pocketbook, purse, bag, brief case, drawer or compartment of a vehicle, or carrying such products on the person for an extended period of time, exposes the products to the risk of contamination from the immediate environment. Pocketbooks, purses, bags, brief cases, drawers, and motor vehicle compartments are not generally considered sterile or aseptic environments. Neither are the pockets of an article of clothing which is worn by an individual in the normal course of daily activity. Thus, the products must be enclosed, and further, should be enclosed by means which are not easily penetrable.

An additional measure of protection is necessary for tampons. Tampons and the cylindrical or rod-like applicators which are used to insert them must not be bent or folded. Deodorant tampon packages and towelette packages present additional problems in that they must be protected from damage due to bending because bending and shearing is likely to cause the packages to tear open. This would allow the moisture element present in the enclosed article to escape. A rigid carrying case would be most suitable to provide protection against bending and similar damage as well as protection against contamination or sullying.

Many women desire discretion in the manner in which they transport feminine hygiene products. If a woman is away from home and has to use feminine hygiene products, she will normally have to go to a restroom to do so. The restroom is usually public or semi-public. She will have to transport the hygiene products to the restroom. In doing so, she will want to have all of the products she plans to use readily accessible and will want her travel to the restroom to be discreet. Discretion normally requires that the hygiene items not be transported in plain view. Discretion and taste limit the choices of transport to pocketbooks, purses, or clothing. However, having to carry a pocketbook or purse to the restroom soley for the purpose of transporting hygiene items can be undesirable to some women. They feel that it is unneccessary and unreasonable to have to transport a pocketbook full of unneeded, divers items to obtain the use of a few products. If a woman's purse is sufficiently small, it is undesirable as a method of transport because it will not be able to contain the necessary items. Use of clothing is often undesirable as a method of transport because it requires that the clothing contain pockets of sufficient size to conceal the hygiene articles or it requires that the articles be concealed in sleeves or other clothing parts ill-suited for that purpose. The use of clothing also means that the hygiene items to be transported must be taken from their immediate place of storage and placed in the clothing or under the clothing upon the person. This cannot always be accomplished discreetly or tastefully. In addition, many women would prefer that an accessory item such as a case which would be used to transport feminine hygiene products have stylish characteristics.

Accordingly, it will be appreciated that it is important to have a case for feminine hygiene products which can be used to discreetly transport feminine hygiene products and which is aesthetically pleasing.

Accordingly, it will also be appreciated that it would be desirable to have a case which incorporates the above characteristics and which is both lightweight and durable.

Accordingly, it will be further appreciated that it would be desirable to have a case which incorporates the characteristics discussed above, which is made from inexpensive materials.

Containers and cases for general and specific purposes other than holding feminine hygiene products are numerous. However, none appear to be suitable to meet the needs described above. The following are a few examples of U.S. patents which have issued for such containers and cases:

| Inventor(s) | U.S. Pat. No. |
|---|---|
| Stephenson | D291,268 |
| Campello | 4,555,020 |
| Klinger | 4,524,871 |
| Bosworth | D275,713 |
| Parkhurst | 4,461,332 |
| Cruz | D274,693 |
| Geer | 4,421,137 |
| Rutherford | D270,387 |
| Papciak | D254,219 |
| Herring | D252,115 |
| Lehn | D243,831 |
| Edwards | D240,353 |
| Paola | D236,556 |
| Ash | D212,068 |
| Swett | 3,484,035 |
| Fluss | D188,959 |
| Ganz | D169,311 |
| Van Dyke | D168,664 |
| Weiss | D155,058 |
| Kaplan | 2,471,963 |
| Worley | D144,533 |
| Reinecke | D132,458 |
| Menn | D121,595 |
| Sampson | 2,215,480 |
| MacDonald | 2,161,715 |
| Graff | D111,537 |
| Graff | D111,536 |
| Ridenour | D109,358 |
| Hannings | 2,102,414 |
| Greenberg | 1,592,457 |

Prior cases for feminine hygiene products are not suitable for carrying and protecting a variety of modern-day feminine hygiene products. There are flexible cases, cases for containing a single item, and cases for carrying a single type of item.

A manufacturer of products may occassionally include as a part of its sale of a box of tampons or other products, a small container for carrying two or three of the manufacturer's own particular product. For example, the Kotex company will occasionally provide a temporary carrying case for holding 3 or 4 of the company's panty liners. Also, the Tambrands company will occasionally include with a package of its tampons a case for carrying 2 or 3 of the tampons with which the case is packaged. Cases specifically designed to house a variety of feminine hygiene products of various sizes do not appear to currently exist in the market place.

Cases for feminine hygiene products for which patents have issued are not effective for housing a variety of feminine hygiene products.

U. S. Pat. No. 4,286,639 to Murphy discloses a flexible, flat wallet-like case for enclosing a single tampon or sanitary napkin. Murphy's teaching is directed to a single-pocket case with the additional object of maintaining thinness. The characteristics of thinness, flexibility and the ability to hold only one tampon or sanitary napkin limit the usefulness of Murphy's invention. It is not suitable for carrying a variety of feminine hygiene products.

U. S. Pat. No. 3,557,853 to Jones discloses a foldable cloth bag for carrying one or two sanitary napkins.

U. S. Pat. No. 2,843,170 to Frankfurt discloses a flexible case for sanitary napkins. The primary disadvantages of the case are that it is flexible and it is configured to primarily accommodate sanitary napkins. In addition, the case's general construction, including its combination of zippers and snaps, does not provide an easily accessible case.

SUMMARY OF THE INVENTION

The invention is directed to addressing the needs and overcoming the problems set forth above.

It is an object of the present invention to provide a case which is specifically designed to house a variety of feminine hygiene products of various sizes, shapes and configurations.

It is also an object of the present invention to provide a case which securely holds a variety of feminine hygiene products of various sizes, shapes and configurations in place within the case.

It is a further object of the invention to provide a case which protects housed feminine hygiene products from damage, or from contamination or sullying from the environment outside of the case.

It is also a further object of the invention to provide a case that attains the above objects and which can be conveniently and easily carried by an individual during daily activities away from the home.

It is another object of the invention to provide a case which attains the above objects and which can be conveniently and easily carried or kept in a pocketbook, purse, tote bag, brief case, desk drawer, compartment of a motor vehicle, or pocket of an article of clothing which is worn by an individual.

It is still another object of the invention to provide a case which attains the above objects and which is both light-weight and durable.

It is still a further object of the invention to provide a case which attains the above objects and which is aesthetically pleasing.

Further still, it is an object of the invention to provide a case which attains the above objects and which is made from inexpensive materials.

According to one aspect of the invention, the above objects are achieved by providing a top compartment connected by a hinge to a bottom compartment. Each compartment is configured to accomodate several feminine hygiene products. Each compartment is equipped with a retaining plate for securing articles within the compartment until the retaining plate is lifted away from the compartment opening. The closed case is compact and aesthetically appealing. Once closed, the case is maintained in its closed position by a locking mechanism until opened by the user. The case is made of a rigid light-weight, durable, inexpensive material.

Other aspects, objects, features and advantages of the present invention will become apparent to those skilled in the art upon reading the detailed description of a preferred embodiment in conjunction with the accompanying drawings and appended claims.

BRIEF DESCRIPTION OF THE ACCOMPANYING DRAWINGS

While the specification concludes with claims particularly pointing out and distinctly claiming the subject matter which is regarded as the present invention, it is believed that the invention will be better understood upon a review of the detailed description of an exemplary embodiment which follows taken in conjunction with the accompanying drawings in which:

FIG. 8 is a front, top perspective view of the case of FIG. 1 in a closed position.

FIG. 9 is a front elevation view of the case of FIG. 8.

DETAILED DESCRIPTION OF A PREFERRED EXEMPLARY EMBODIMENT

Figure 1:
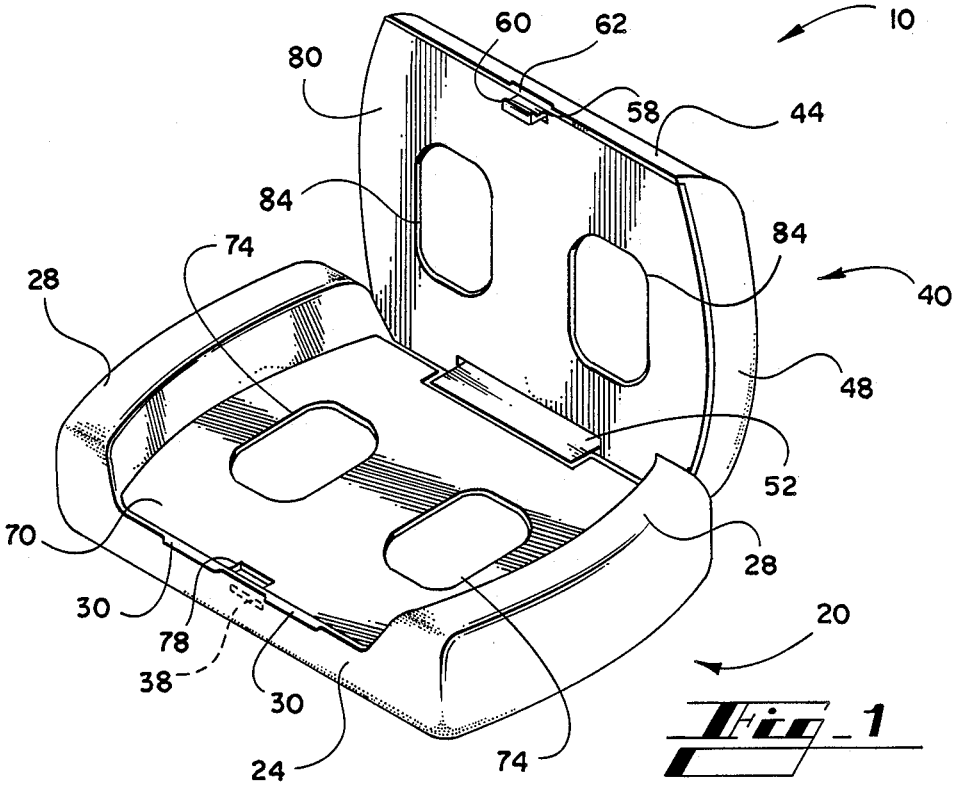
FIG. 1 is a front, top perspective view of a case for feminine hygiene products according to an exemplary embodiment of the invention in an open position.

Referring now to the drawings in more detail, each feature is denoted by the same numeral throughout the illustrations.

FIG. 1 shows a case for feminine hygiene products 10 according to a preferred exemplary embodiment of the invention. The case 10 is shown in an open position with the top compartment 40 pivoted away from the bottom compartment 20. This view of the bottom compartment 20 shows the bottom-compartment front wall 24, the bottom-compartment rear wall 26 and the end portions 28. The bottom compartment 20 is configured to contain various combinations of feminine hygiene products including, but not limited to, the following combinations: two (2) regular feminine hygiene pads or four (4) super tampons and two (2) panty liners or four (4) maxi shields.

Products are held in place in the bottom compartment 20 by the lower retaining plate 70. Openings 74 in the lower retaining plate 70 permit viewing of the objects held in the bottom compartment 20. Retaining plates 70 and 80 are identical.

FIG. 1 also shows the top compartment's 40 top-compartment front wall 44, an end wall 48 of the top compatment 40 and hinge support 52 which extends from the top-compartment rear wall 46 and forms a part of the hinge for connecting the top compartment 40 and bottom compartment 20. The upper retaining plate 80 secures products in the top compartment 40. Openings 84 in the upper retaining plate 80 permit viewing of items held in the top compartment 40. The top compartment 40 can house a variety of combinations of products including, but not limited to, the following combinations: two (2) panty liners or one (1) maxi shield or two (2) feminine hygiene towelletes or, perhaps, several condoms.

FIG. 1 further reveals a part of the locking mechanism for the case 10. A flexible tab member 58 extends from the inner surface of the top-compartment front wall 44. A lip 60 is formed at the end of the tab 58. When the top compartment and bottom compartment 20 are pivoted to a closed position with respect to each other and pressed together, the tab 58 flexes to permit the lip 60 to slip into the tab groove 38 which is formed on the inside surface of the bottom-compartment front wall 24. The closed case 10 may be opened by grasping the first grasping lip 62 located on the outer surface of the top-compartment front wall 44 and the set of second grasping lips 30 located on the outer surface of the bottom-compartment front wall 24. The notch 78 in both the lower retaining plate 70 and the upper retaining plate 80 prevent interference between the tab 58 and the retaining plates 70 and 80.

Figure 2:
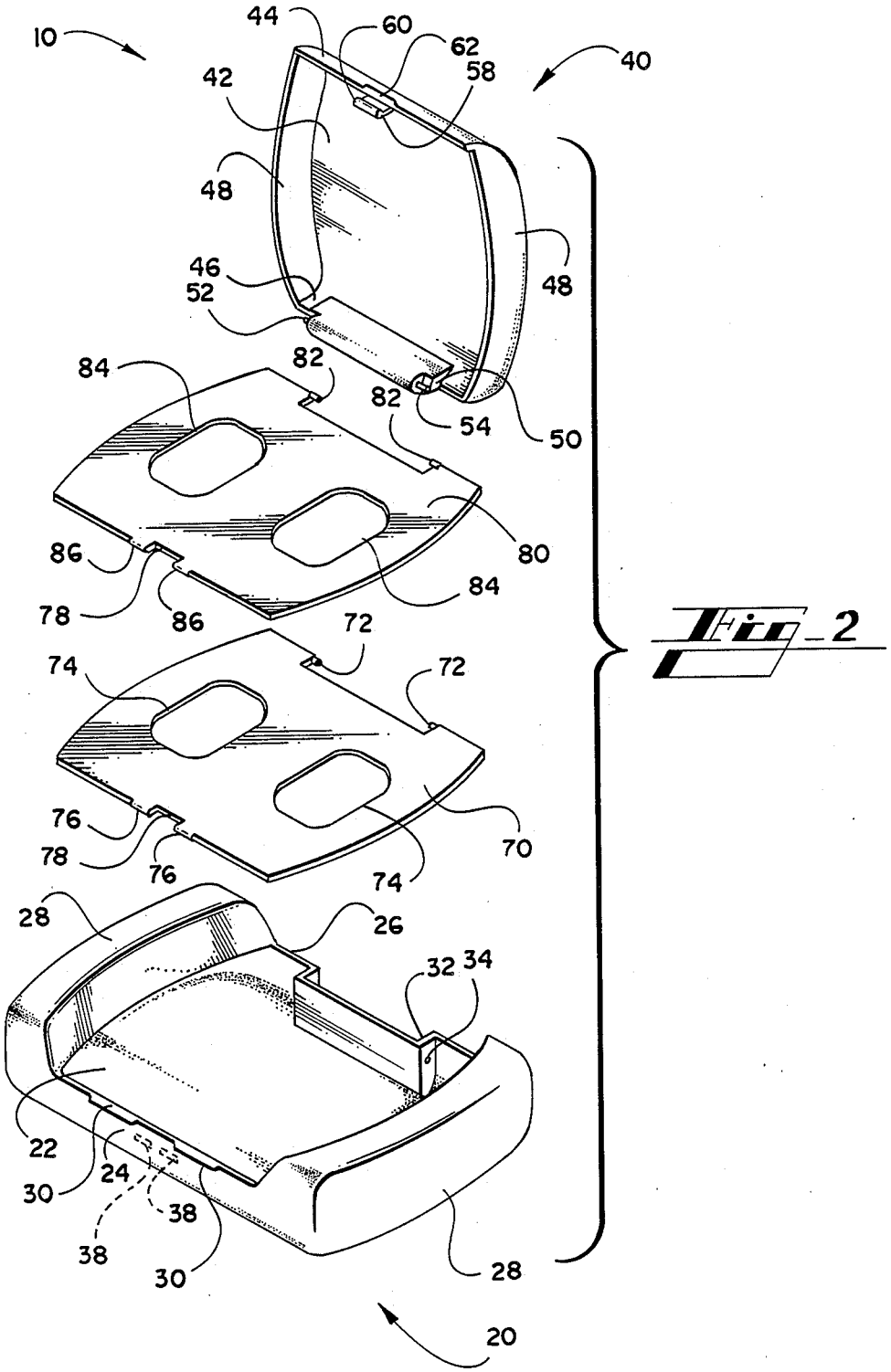
FIG. 2 is an exploded front, top perspective view of the case of FIG. 1.
Figure 3:
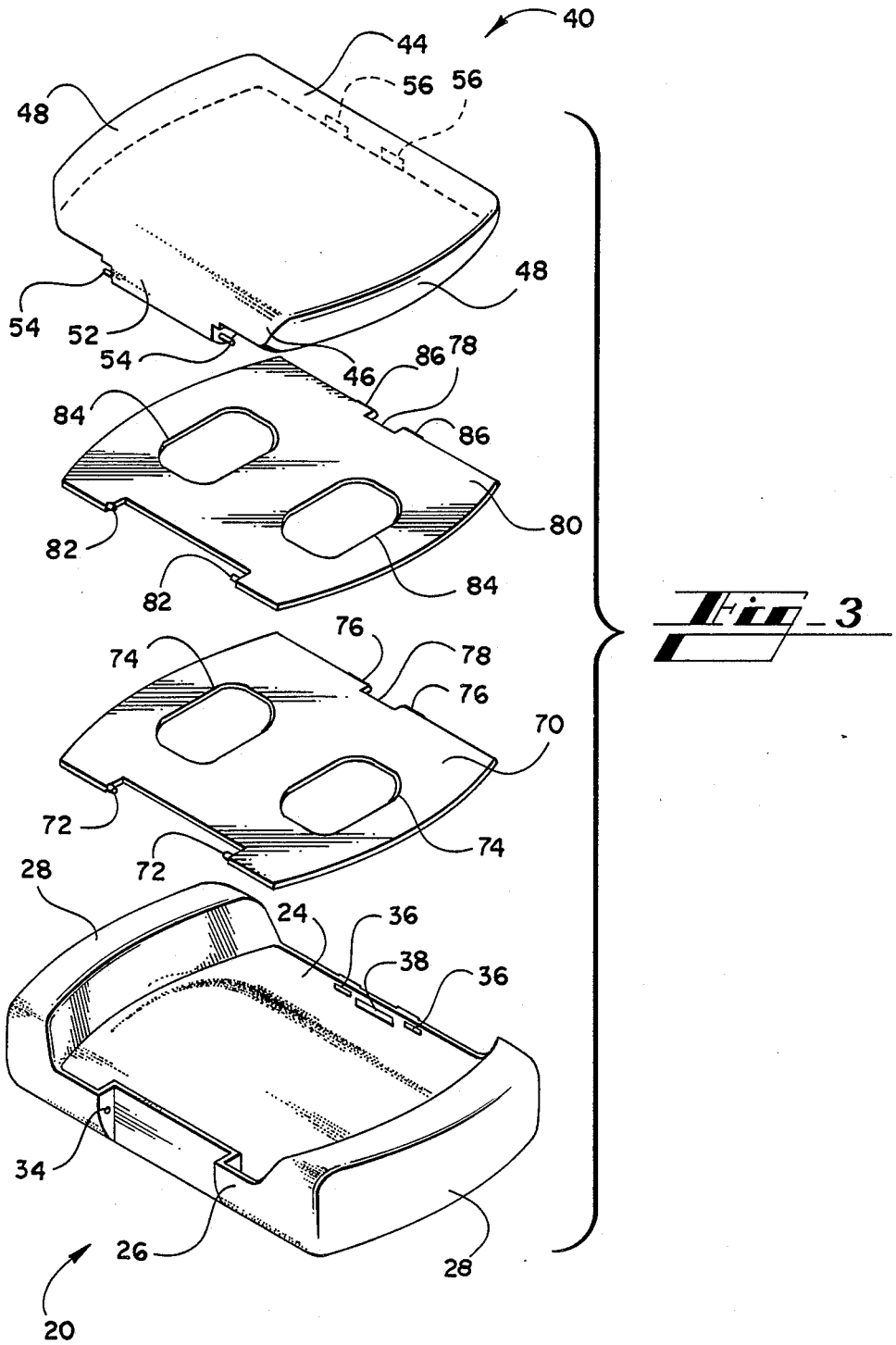
FIG. 3 is an exploded rear, top perspective view of the case of FIG. 1.

FIGS. 2 and 3 illustrate the manner in which the bottom compartment 20, top compartment 40, and their respective openings are formed. The specially configured bottom compartment 20 is formed by bottom wall 22, bottom-compartment front wall 24, bottom-compartment rear wall 26 and end portions 28. The bottom compartment 20 is especially elongated to hold tampons and other feminine hygiene products of similar length. The end portions 28, which may be described as box-like covers, overlap the respective ends of the bottom compartment 20. The end portions 28 thus help to secure tampons or other elongated objects whose ends extend beyond the opening of the bottom compartment 20 when the objects are placed in the bottom compartment 20. Overlapping by the end portions 28 also serves to increase the general rigidity and stability of the bottom compartment 20 by decreasing its ability to be bent, twisted or otherwise deformed. The height of the end portions 28 above the opening of the bottom-compartment 20 corresponds to the height of the top compartment's front wall 44, rear wall 46 and end walls 48. The opening of the bottom compartment 20 is defined by the bottom-compartment front wall 24, the bottom-compartment rear wall 26, and end portions 28. The opening of the top compartment 40 is slightly smaller longitudinally than the opening of the bottom compartment 20. The opening of the top compartment 40 is defined by the top-compartment front wall 44, the top-compatment rear wall 46 and end walls 48 of the top compartment. Together with these elements, the top compartment's top wall 42 completes the top compartment 40. The above-described dimensions of the bottom-compartment 20 and the top compartment 40 enable the two to fit snugly together when closed, providing a flush exterior for the case 10 and enabling the case 10 to hold a variety of feminine hygiene products. The snugness of the fit between the compartments plus the flush exterior enhance the case's 10 strength, appearance and resistance to accidental opening.

The exploded view of FIG. 2 illustrates more details of the exemplary embodiment of the case 10. The lower retaining plate hinge pins 72 fit into the apertures 32 located on the bottom-compartment rear wall 26 to create a hinge axis about which the lower retaining plate is pivoted onto or away from the bottom compartment 20.

The exploded view of FIG. 3 further illustrates the detailed structure of the exemplary embodiment of the case 10. A hinge support 52 integrally formed with and extending from the top-compartment rear wall 46 has top-compartment hinge pins 54 projecting from it which fit into the apertures 34 to form the hinge axis about which the top compartment 40 and bottom compartment 20 are pivoted.

Upper retaining plate hinge pins 82 fit into the apertures 50 formed in the top-compartment rear wall 46 to create a hinge axis about which the upper retaining plate 80 may be pivoted onto or away from the top compartment 40.

A variation of the hinge structure includes a single hinge axis about which the bottom compartment 20, the top compartment 40, lower retaining plate 70 and upper retaining plate 80 would all pivot. Another variation would include a single hinge support for all of the hinges.

The lower retaining plate 70 and upper retaining plate 80 contain locking lips 76 and 86, respectively. When the retaining plates 70 and 80 are pivoted onto their respective compartments 20 and 40 and pressed into place, the lips 76 and 86 slip into the grooves 36 and 56, respectively, which are formed on the inner surfaces of front walls 24 and 44, respectively. This causes the plates 70 and 80 to lock into place over the respective compartments 20 and 40. A slight amount of force may be applied to pivot the retaining plates 70 and 80 away from their respective compartments 20 and 40. The retaining plates 70 and 80 may be grasped through their respective openings 74 and 84 to facillitate such pivoting.

Figure 4:
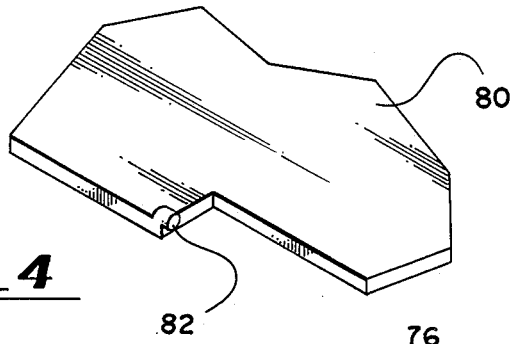
FIG. 4 is a fragmentary view of the rear portion of the retaining plates of FIGS. 3 and 4.
Figure 5:
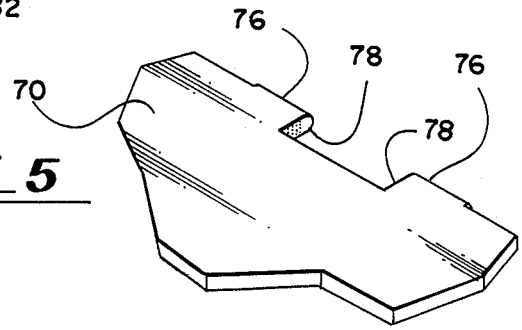
FIG. 5 is a fragmentary view of the front portion of the retaining plates of FIGS. 3 and 4.

Since the retaining the plates 70 and 80 are identical, manufacturing economy is gained. An enlarged detailed illustration of a retaining plate hinge pin 72 and 82 is shown in FIG. 4. An enlarged detailed illustration of a retaining plate locking lip 76 and 86 is shown in FIG. 5.

Figure 6:
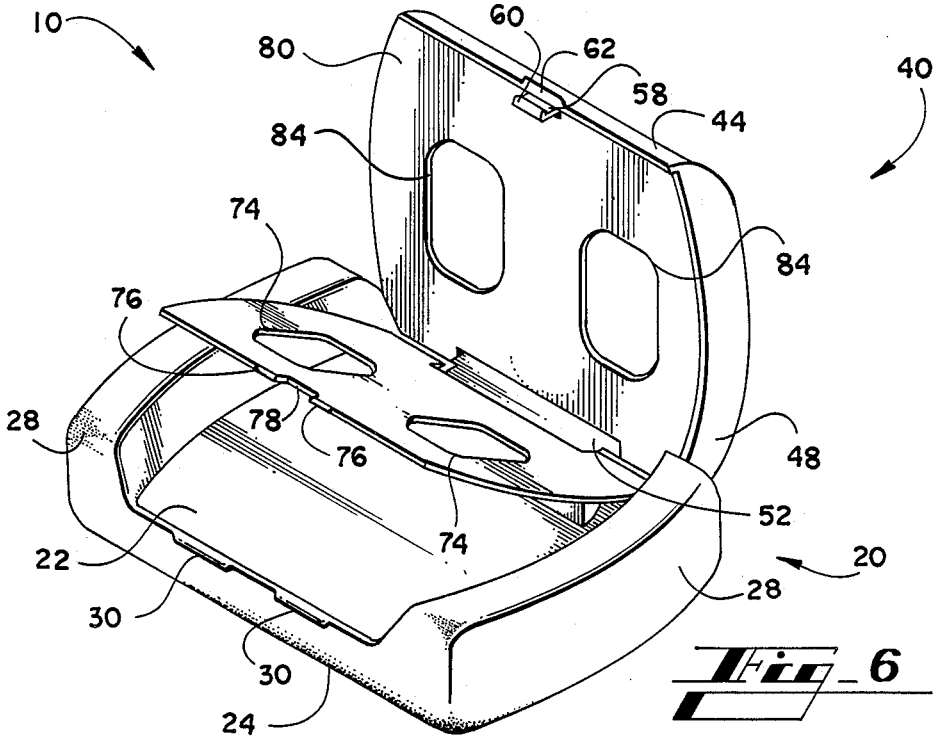
FIG. 6 is a front, top perspective view of the case of FIG. 1 with the lower retaining plate pivoted away from the bottom compartment.
Figure 7:
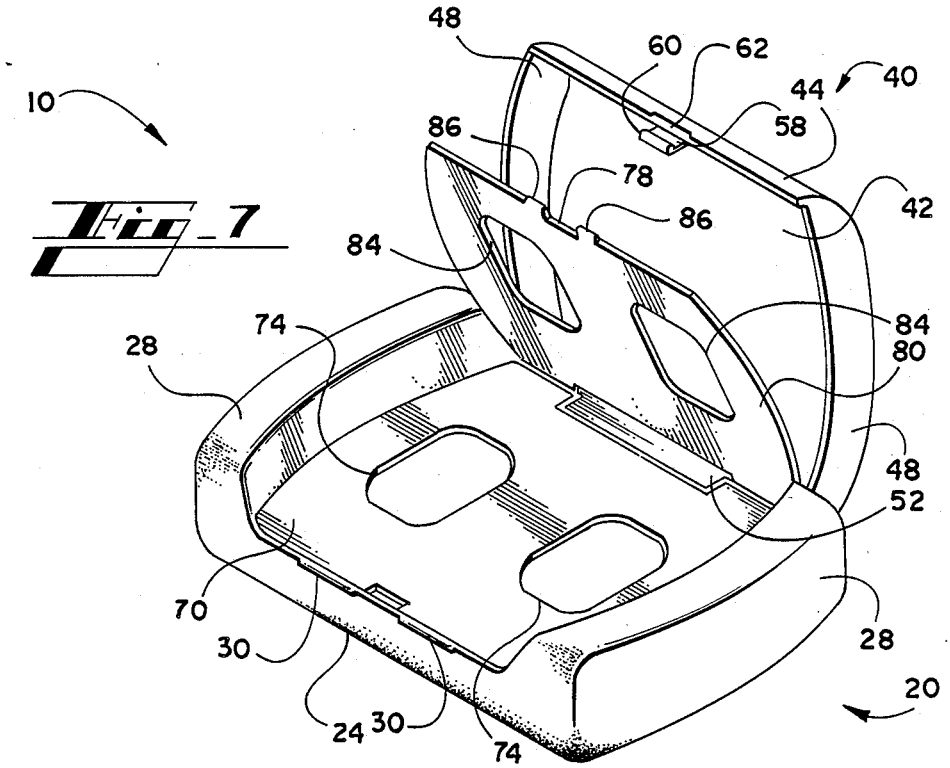
FIG. 7 is a front, top perspective view of the case of FIG. 1 with the upper retaining plate pivoted away from the top compartment.

An open case 10 with the lower retaining plate 70 pivoted away from the bottom compartment 20 to allow access thereto is illustrated in FIG. 6. FIG. 7 illustrates the open case 10 with the upper retaining plate 80 pivoted away from the top compartment 40 to allow access thereto.

The compact, contoured, streamlined features of the case 10 are shown in FIG. 8's illustration of the case 10 in the closed position. Those same features are further illustrated in the front view of the exemplary embodiment of the case 10 as shown in FIG. 9.

Figure 10:
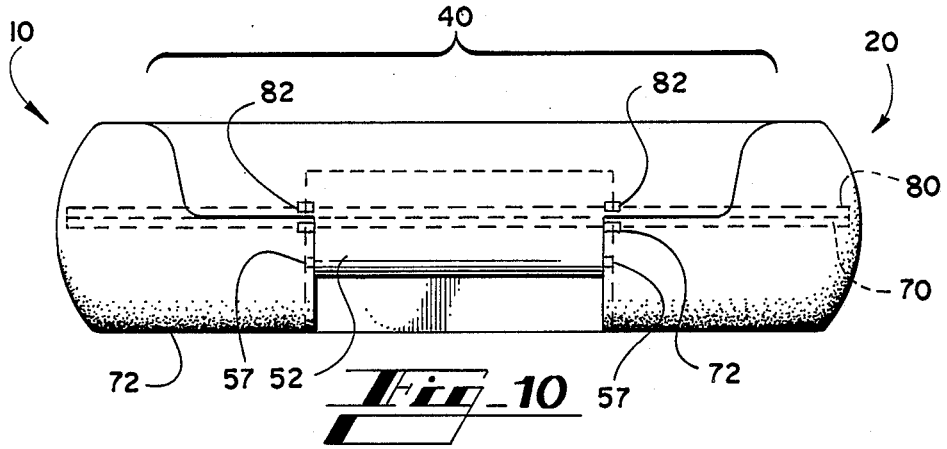
FIG. 10 is a rear elevation view of the case of FIG. 8.
Figure 11:
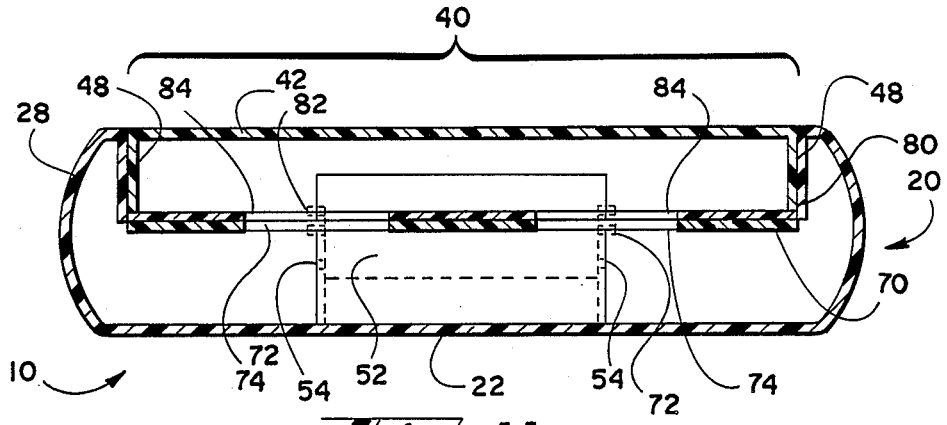
FIG. 11 is a sectional view of the case of FIG. 8 taken along line 11—11.

FIG. 10 is a "see-through" rear view of the exemplary embodiment of a closed case 10. This view illustrates the alignment of the retaining plates 70 and 80 and the top-compartment hinge support 52 when the case 10 is in a closed position. FIG. 11 is a sectional view of the exemplary embodiment of a closed case 10 taken along line 11—11 of FIG. 8. The alignment of the previously discussed elements with respect to one another is further illustrated.

Figure 12:
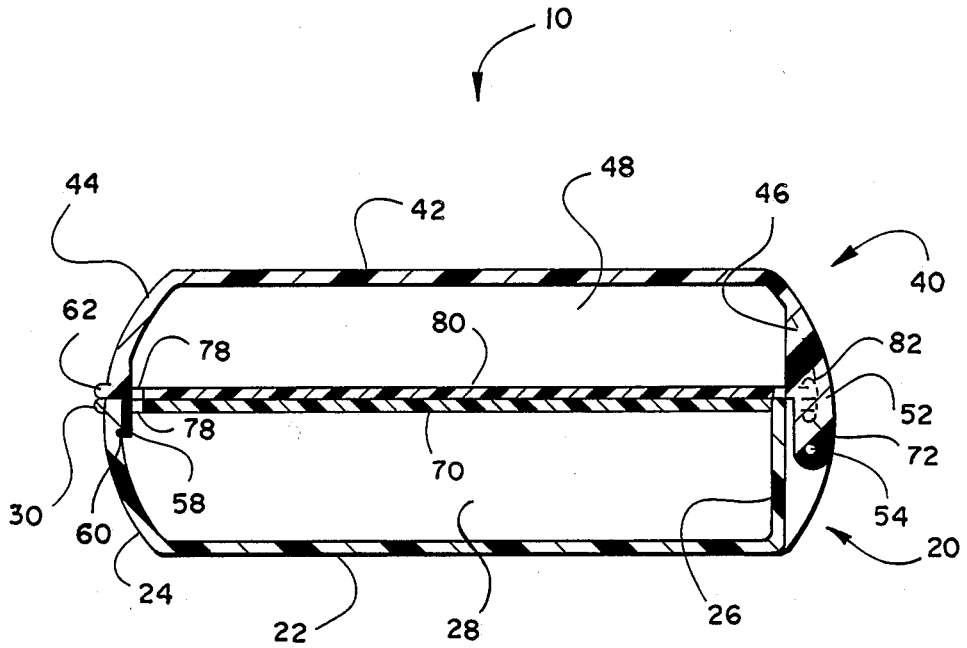
FIG. 12 is a sectional view of the case of FIG. 8 taken along line 12—12.

FIG. 12 is a sectional view of the exemplary embodiment of a closed case 10 taken along line 12—12 of FIG. 8. This view illustrates the relationship of the retaining plates 70 and 80, tab lock (comprised of flexible tab member 58, lip of flexible tab member 60, and tab groove 38), and top and bottom compartments 40 and 20, respectively, when the case 10 is closed. The figure also provides a cross-sectional view of the connection of the top compartment 40 and bottom compartment 20 via the top compartment hinge support 52. The two compartments pivot about a hinge axis defined by points where the top-compartment hinge pins 54 connect to the bottom-compartment rear wall 26.

Figure 13:
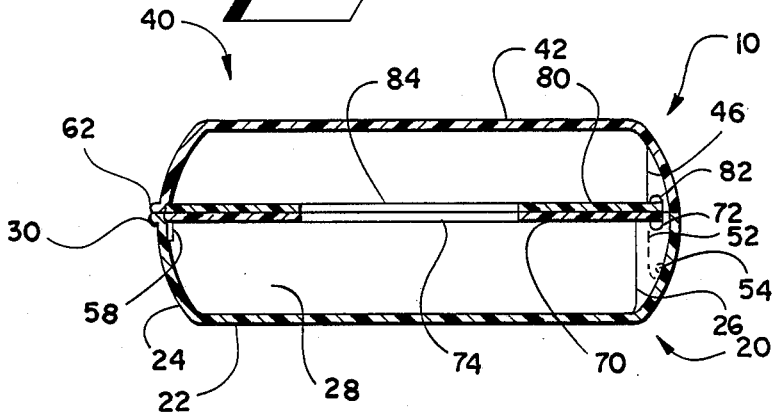
FIG. 13 is a sectional view of the case of FIG. 8 taken along line 13—13.

FIG. 13 is a sectional view of the exemplary embodiment of a closed case 10 taken along line 13—13 of FIG. 10 further illustrating the features highlighted in FIG. 12.

The case and all of its parts may be constructed of a strong, rigid but light-weight material such as plastic. The use of plastic is also desirable because it is relatively inexpensive.

As is apparent from the foregoing specifications, the invention is susceptible of being embodied with various alterations and modifications which may differ particularly from those which have been described in the preceding specification and description. Accordingly, the following claims shall cover all such alterations and modifications as do not depart from the true spirit and scope of the invention.

What is claimed is:

1. A case for feminine hygiene products comprising:

a substantially open, box-like bottom compartment having a bottom wall, a bottom-compartment front wall, a bottom-compartment rear wall, and bottom compartment end walls, said bottom wall, said bottom-compartment front wall, and said bottom-compartment rear wall extending to said bottom-compartment end walls forming ends of said substantially-open, box-like bottom compartment, said substantially-open, box-like bottom compartment also having a box-like cover extending above each said end, respectively, said bottom-compartment front wall, said bottom-compartment rear wall, and said box-like covers defining a bottom-compartment opening;

a box-like top compartment having a top wall, a top-compartment front wall, a top-compartment rear wall, and a top-compartment end wall at each end thereof, said top-compartment front wall, said top-compartment rear wall and said top-compartment end walls defining a top-compartment opening slightly longitudinally shorter than but otherwise equal to said bottom-compartment opening, said top compartment having a depth equal to the distance which said box-like covers of said bottom compartment extend above said bottom-compartment front wall and said bottom-compartment rear wall;

a lower retaining plate;

an upper retaining plate;

means for removably positioning said upper retaining plate over said top-compartment opening;

means for removably positioning said lower retaining plate over said bottom-compartment opening; and means for selectively positioning said top compartment over said bottom compartment with said top-compartment opening and said bottom-compartment opening facing each other.

2. A case for feminine hygiene products comprising:

a substantially open, box-like bottom compartment having a bottom wall, a bottom-compartment front wall, a bottom-compartment rear wall, and bottom-compartment end walls, said bottom wall, said bottom-compartment front wall, and said bottom-compartment rear wall extending to said bottom-compartment end walls forming ends of said substantially-open, box-like bottom compartment, said substantially-open, box-like bottom compartment also having a box-like cover extending above each said end, respectively, said bottom-compartment front wall, said bottom-compartment rear wall, and said box-like covers defining a bottom-compartment opening;

a box-like top compartment having a top wall, a top-compartment front wall, a top-compartment rear wall, and a top-compartment end wall at each end thereof, said top-compartment front wall, said top-compartment rear wall and said top-compartment end walls defining a top-compartment opening slightly longitudinally shorter than but otherwise equal to said bottom-compartment opening, said top compartment having a depth equal to the distance which said box-like covers of said bottom compartment extend above said bottom-compartment front wall and said bottom-compartment rear wall;

first hinge means connecting said top compartment and said bottom compartment along said top-compartment rear wall and said bottom-compartment rear wall;

a lower retaining plate;

an upper retaining plate;

second hinge means connecting said lower retaining plate to said bottom compartment; third hinge means connecting said upper retaining plate to said top compartment.

3. A case for feminine hygiene products according to claim 2, further comprising:

a flexible tab member having an end attached to and extending from an inside surface of said top-compartment front wall, said flexible tab member extending away from said top-compartment opening, said flexible tab member having another end forming a lip protruding outwardly from a plane of said flexible tab member toward said top-compartment front wall; and a tab groove formed by said bottom-compartment front wall on an inside surface thereof at a position to receive said lip of said flexible tab member when said top compartment is pivoted about said first hinge means to a closed position over said bottom compartment;

whereby said flexible tab member and said tab groove cooperate to lock said top-compartment front wall and said bottom-compartment front wall together when said top compartment and said bottom compartment are pivoted and pressed together, and cooperate to unlock said top-compartment front wall and said bottom-compartment front wall when said top compartment and said bottom compartment are pivoted away from each other.

4. A case for feminine hygiene products according to claim 2, further comprising:

at least one locking lip member integrally formed with and protruding from an edge of said lower retaining plate, which said edge is proximate said bottom-compartment front wall when said lower retaining plate is positioned over said bottom compartment; and at least one groove defined by an inside surface of said bottom-compartment front wall, corresponding respectively to said at least one locking lip member of said lower retaining plate;

whereby when said lower retaining plate is forcefully pivoted to a closed position over said bottom-compartment opening said at least one locking lip member is impelled respectively into said at least one groove and cooperates respectively with said at least one groove to maintain said lower retaining plate in position over said bottom-compartment opening, and when said lower retaining plate is forcefully pivoted away from said bottom-compartment opening, said at least one locking lip member and said at least one groove cooperate respectively to release said at least one locking lip member from said at least one groove.

5. A case for feminine hygiene products according to claim 2, further comprising:

at least one locking lip member integrally formed with and protruding from an edge of said upper retaining plate, which said edge id proximate said top-compartment front wall when said upper retaining plate is positioned over said top compartment; and at least one groove defined by an inside surface of said top-compartment front wall, corresponding respectively to said at least one locking lip member of said upper retaining plate;

whereby when said upper retaining plate is forcefully pivoted to a closed position over said top-compartment opening said at least one locking lip member is impelled respectively into said at least one groove and cooperates respectively with said at least one groove to maintain said upper retaining plate in position over said top-compartment opening, and when said upper retaining plate is forcefully pivoted away from said top-compartment opening, said at least one locking lip member and said at least one groove cooperate respectively to release said at least one locking lip member from said at least one groove.

6. A case for feminine hygiene products according to claim 2, wherein said lower retaining plate defines at least one opening therethrough for allowing items retained by said lower retaining plate to be viewed and for facilitating gripping of said lower retaining plate.

7. A case for feminine hygiene products according to claim 2, wherein said upper retaining plate defines at least one opening therethrough for allowing items retained by said upper retaining plate to be viewed and for facilitating gripping of said upper retaining plate.

8. A case for feminine hygiene products comprising:

a substantially open, box-like bottom compartment having a bottom wall, a bottom-compartment front wall, a bottom-compartment rear wall and covered end portions extending vertically above said bottom-compartment front wall and said bottom compartment rear wall, said bottom-compartment front wall, said bottom-compartment rear wall and said end portions defining a bottom-compartment opening;

a box-like top compartment having a top wall, a top-compartment front wall, a top-compartment rear wall, and an end wall at each end thereof, said top-compartment front wall, said top-compartment rear wall and said end walls defining a top-compartment opening slightly longitudinally shorter than but otherwise equal to said bottom-compartment opening, said top compartment having a depth equal to the distance which said covered end portions of said bottom compartment extend above said bottom-compartment front wall and said bottom-compartment rear wall;

first hinge means connecting said top compartment and said bottom compartment at said top-compartment rear wall and said bottom-compartment rear wall;

a lower retaining plate slightly smaller than said bottom-compartment opening, said lower retaining plate defining at least one opening therethrough for allowing items retained by said lower retaining plate to be viewed and for facilitating gripping of said lower retaining plate;

an upper retaining plate slightly smaller than said top-compartment opening, said upper retaining plate defining at least one opening therethrough for allowing items retained by said upper retaining plate to be viewed and for facilitating gripping of said upper retaining plate;

second hinge means connecting said lower retaining plate to said bottom compartment at said bottom-compartment rear wall;

third hinge means connecting said upper retaining plate to said top compartment at said top-compartment rear wall;

means for selectively locking said top compartment and said bottom compartment in a closed position with respect to one another.

9. A case for feminine hygiene products according to claim 8, wherein said first hinge means connecting said top compartment and said bottom compartment, said second hinge means and said third hinge means comprise a single hinge means which pivots about a single hinge axis.

10. A case for feminine hygiene products according to claim 8, further comprising at least one hinge support which simutaneously supports said first hinge means, said second hinge means, and said third hinge means.

11. A case for feminine hygiene products according to claim 9, wherein said at least one hinge support comprises a member extending vertically from said bottom-compartment rear wall.

12. A case for feminine hygiene products according to claim 8, wherein said upper retaining plate and said lower retaining plate are identical.

13. A case for feminine hygiene products comprising:

a substantially-open, box-like bottom compartment having a bottom wall, a bottom-compartment front wall, a bottom-compartment rear wall, and bottom-compartment end walls, said bottom wall, said bottom-compartment front wall, and said bottom-compartment rear wall extending to said bottom-compartment end walls forming ends of said substantially-open, box-like bottom compartment, said substantially-open, box-like bottom compartment also having a box-like cover extending above each said end, respectively, said bottom-compartment front wall, said bottom-compartment rear wall, and said box-like covers defining a bottom-compartment opening;

a box-like top compartment having a top wall, a top-compartment front wall, a top-compartment rear wall, and a top-compartment end wall at each end thereof, said top-compartment front wall, said top-compartment rear wall and said top-compartment end walls defining a top-compartment opening slightly longitudinally shorter than but otherwise equal to said bottom-compartment opening, said top compartment having a depth equal to the distance which said box-like covers of said bottom compartment extend above said bottom-compartment front wall and said bottom-compartment rear wall;

first hinge means connecting said top compartment and said bottom compartment along said top-compartment rear wall and said bottom-compartment rear wall;

a lower retaining plate;

an upper retaining plate;

second hinge means connecting said lower retaining plate to said bottom compartment;

third hinge means connecting said upper retaining plate to said top compartment;

at least one first grasping lip member protruding outwardly from an outer surface of said top-compartment front wall and at least one second grasping lip member protruding outwardly from an outer surface of said bottom-compartment front wall, whereby when the case is in a closed position said at least one first grasping lip member and said at least one second grasping lip member may be grasped by a person to facilitate pivoting of said top compartment and said bottom compartment away from each other.

14. A case comprising:

a bottom compartment having a rear wall forming a recessed area, said rear wall defining a pair of first apertures for receiving hinge pins and defining a pair of second apertures for receiving pintels;

a top compartment having a rear wall forming a U-shaped hinge member having a pintel protruding from each of two sides of said U-shaped hinge member, each said side of said U-shaped hinge member defining a third aperture for receiving a hinge pin;

a lower retaining plate having a pair of hinge pins formed at a back edge thereof;

an upper retaining plate having a pair of hinge pins formed at a back edge thereof;

whereby said U-shaped hinge member fits within said recessed area of said bottom compartment and said pintels of said U-shaped hinge member are received by said second apertures of said bottom compartment and said upper retaining plate hinge pins are received by said third apertures for receiving hinge pins and said lower retaining plate hinge pins are received by said first apertures for receiving hinge pins, such that said top compartment and said bottom compartments are pivotable with respect to one another about an axis defined by said pintels, said upper retaining plate is pivotable with respect to said top compartment about an axis defined by said upper retaining plate hinge pins, and said lower retaining plate is pivotable with respect to said bottom compartment about an axis defined by said lower retaining plate hinge pins.

* * * * *